US006384311B1

(12) United States Patent
Cota

(10) Patent No.: US 6,384,311 B1
(45) Date of Patent: May 7, 2002

(54) GUITAR HAVING TREMOLO DEVICE ON EACH STRING THEREOF

(76) Inventor: Jose G. Cota, 2928 E. Lemarche, Phoenix, AZ (US) 85032

( * ) Notice: Subject to any disclaimer, the term of this patent is extended or adjusted under 35 U.S.C. 154(b) by 0 days.

(21) Appl. No.: 09/781,807

(22) Filed: Feb. 12, 2001

(51) Int. Cl.[7] ..... G10D 3/06; G10D 3/14; G10H 1/053; G10H 1/34; G10H 3/18

(52) U.S. Cl. ..... 84/739; 84/742; 84/312 R; 84/313; 84/314 R; 84/DIG. 30; 84/267

(58) Field of Search ..... 84/312 R, 312 P, 84/313, 314 R, 314 N, 722–746, 646, DIG. 30, 267

(56) References Cited

U.S. PATENT DOCUMENTS 2,741,146 A * 4/1956 Fender ..... 84/313
3,478,158 A * 11/1969 Trainor ..... 84/313 X
3,479,917 A * 11/1969 Zitnik et al. ..... 84/313 X
4,516,462 A * 5/1985 Schulze ..... 84/313 X
4,611,523 A * 9/1986 McFarland ..... 84/313
4,782,732 A * 11/1988 Kato et al. ..... 84/313
5,442,986 A 8/1995 Cota
5,590,771 A 1/1997 Cota
6,084,166 A * 7/2000 Lee ..... 84/313
6,156,961 A * 12/2000 Beckmeier ..... 84/317 R X

* cited by examiner

*Primary Examiner*—Stanley J. Witkowski
(74) *Attorney, Agent, or Firm*—Frank J. McGue

(57) ABSTRACT

A stringed instrument comprises, in combination, a body with a neck extending forwardly therefrom The neck has a tuning portion mounted opposite the body which is adapted to receive one end of a plurality of strings. The tuning portion adjusts the tension on each of the plurality of strings. The other end of the plurality of stings is attached to the body. A plurality of pickup elements is positioned on the body proximate to the neck. The plurality of pickup elements is underneath the plurality of strings. The plurality of pickup elements are also in electrical communication with a position sensitive switch which determines which of the plurality of pickup elements is actuated in response to movement of the body. A plurality of tremolo mechanisms corresponding to the plurality of strings is attached to the end of the plurality of strings attached to the body. Also, interchangeable fret boards are mountable on the neck.

24 Claims, 5 Drawing Sheets

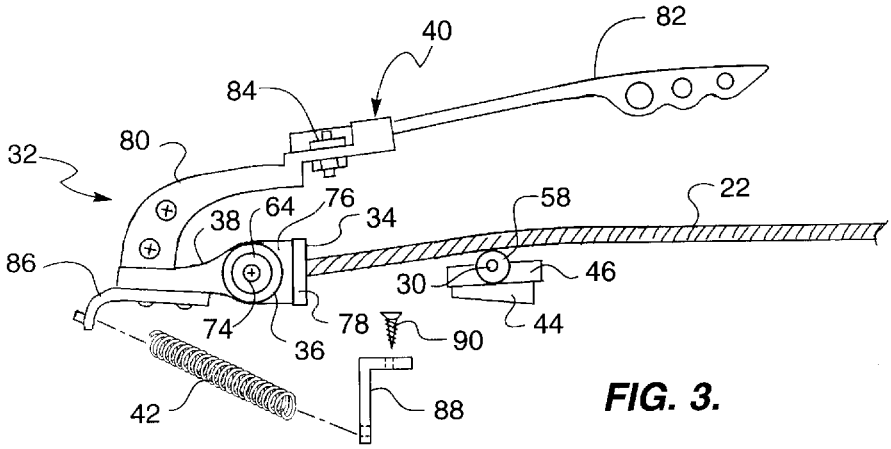
FIG. 3.
FIG. 4.
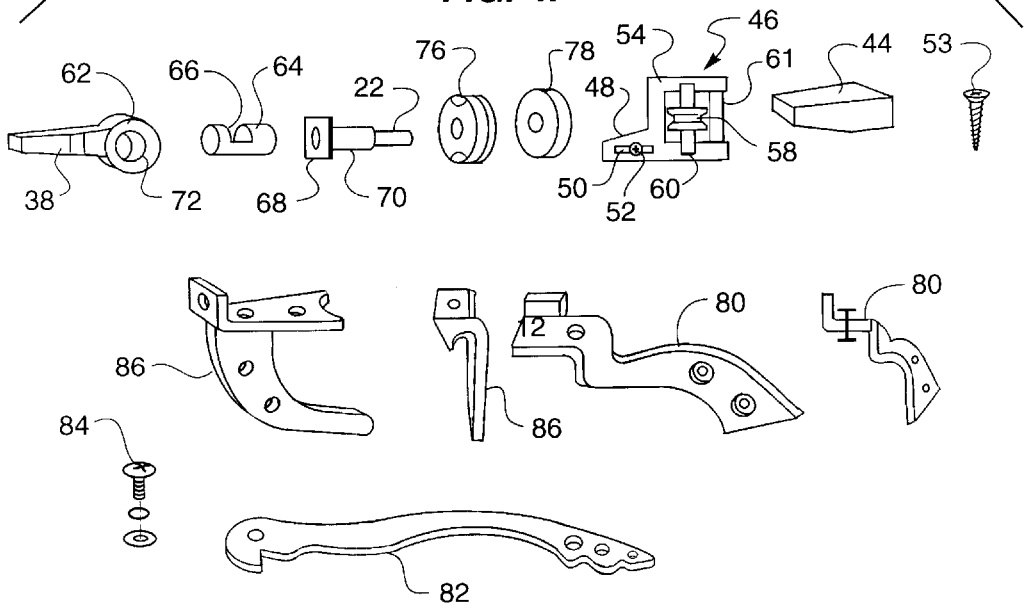

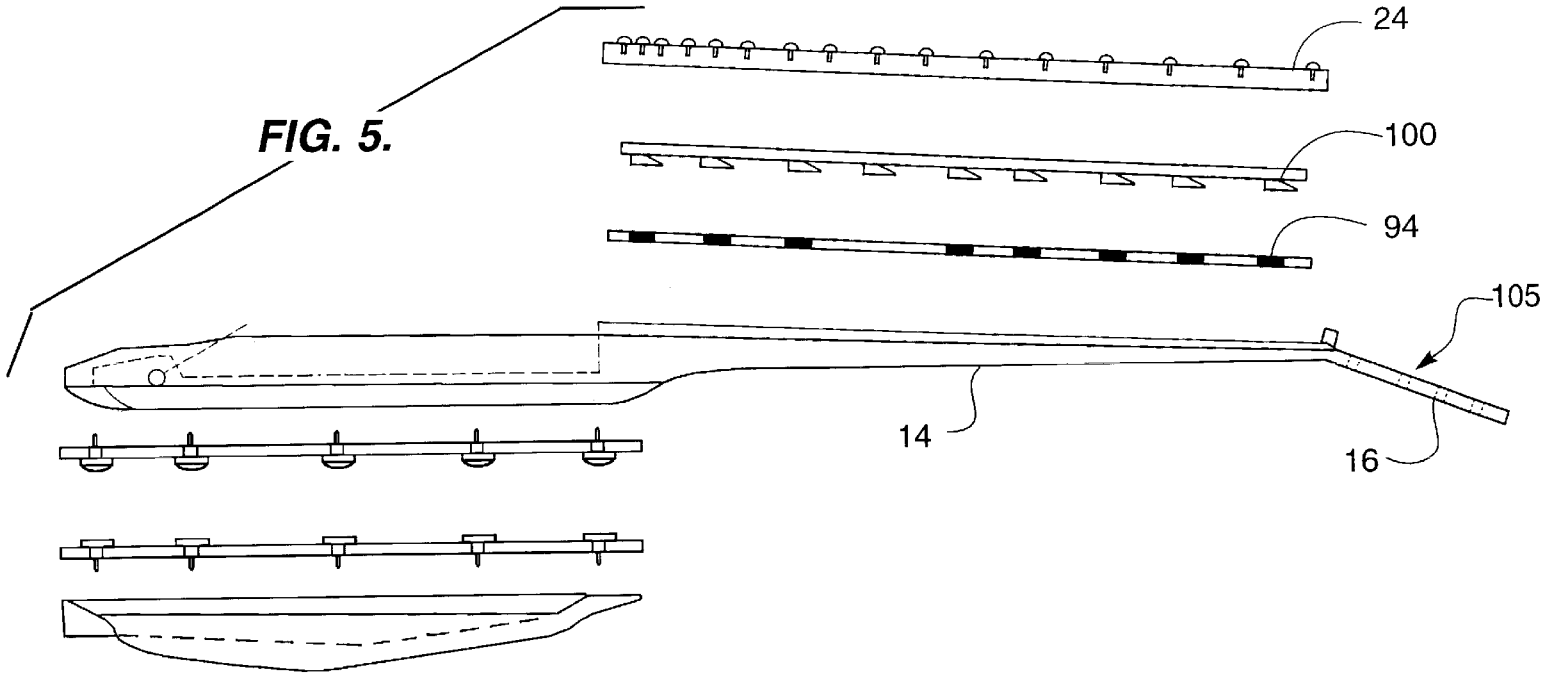
FIG. 5.
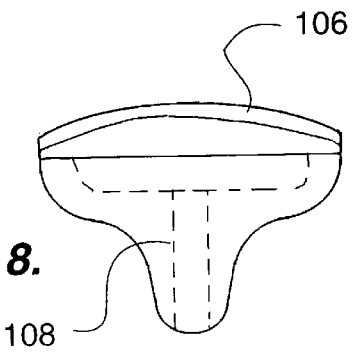
FIG. 8.
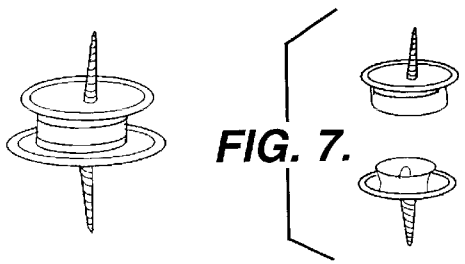
FIG. 7.
FIG. 6.

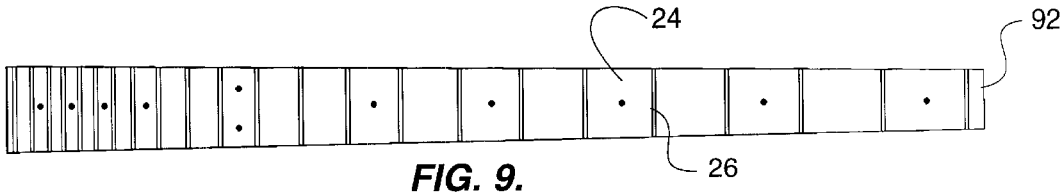
FIG. 9.
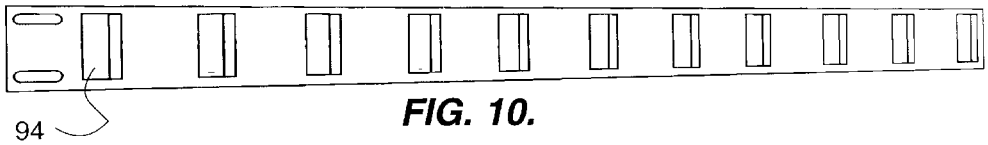
FIG. 10.
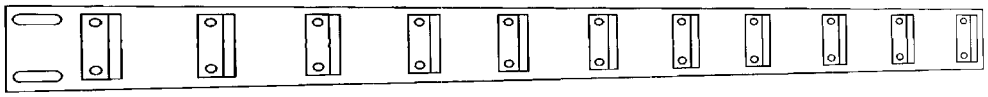
FIG. 11.
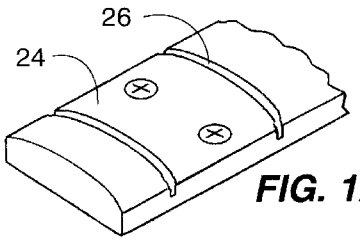
FIG. 12.
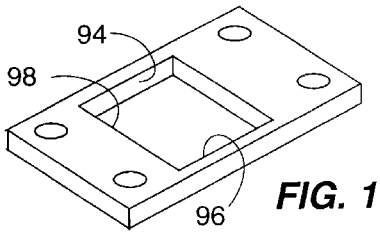
FIG. 13.
FIG. 14.
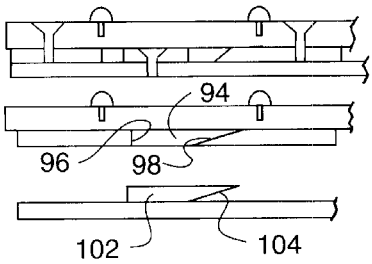
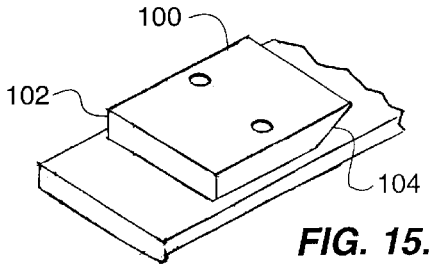
FIG. 15.

GUITAR HAVING TREMOLO DEVICE ON EACH STRING THEREOF

TECHNICAL FIELD

The present invention relates to stringed instruments, and, more particularly, to a guitar having interchangeable fretboards, a novel switchboard pickup mechanism and individual tremolo mechanisms for each string thereof.

BACKGROUND OF THE INVENTION

Music has always provided a popular source of entertainment and pleasure to persons from all over the world. However, modern musicians also want control of the sounds generated by such instruments.

Electromagnetic pickup elements that detect the mechanical vibrations of the strings and convert these to electrical signals for amplification and subsequent playback in speakers are well known to those skilled in the art. Also well known is the use of multiple pickup elements placed in various configurations relative to the guitar strings to obtain distinct frequency components of the mechanical string vibrations. Moreover, musicians are able to switch from one to another of these pickup elements during play or to switch to combinations of two or more pickup elements to provide a plurality of electrically amplified guitar sounds.

One problem noted in the prior art is the inability to quickly and accurately switch from one or another of the pickup elements without interrupting the play of the guitar. Improvements in switching technology include Starr, U.S. Pat. No. 4,711,149, which teaches an electronic push button switching system that allows rapid, unobtrusive switching between multiple pickup elements or combinations thereof Starr thereby provides a simple and accurate switching control during guitar play.

Another improvement in switching technology includes Cota (the present applicant), U.S. Pat. No. 5,442,986, which uses the opening and closing of a hinged top portion of a multiple coil pickup device to change the tone or pitch of the resultant guitar string sounds.

It is also well known in the art to provide a tremolo mechanism which allows the musician to change the tension of the strings while said strings are vibrating. Such mechanisms generally comprise a lever having one end connected to a base plate to which said strings are attached. When the other end of the lever is lifted by the musician, the resultant pull on the base plate increases the tension on the strings thereby resulting in a different sound. However, such mechanisms always act upon all the strings of a guitar simultaneously. Thus, there is a need for a tremolo mechanism which allows the musician to selectively alter the tension on each of the guitar strings separately.

Lastly, it is also well known in the art to provide different fret board configurations to provide a multiplicity of sounds. Cota (the present applicant), in U.S. Pat. No. 5,442,986, describes interchangeable fret boards that alternately extend and are secured by screws to a playing position, or retract within a guitar body for storage or carrying. However, there is a need for an interchangeable fret board which is easily attached to and detached from the neck of a guitar.

The present invention meets these needs.

SUMMARY OF THE INVENTION

In accordance with the invention claimed a number of improvements are made in electronically amplified stringed instruments.

It is, therefore, one object of this invention to provide an electronically amplified stringed instrument having a plurality of electronic pickup elements and means for switching between the plurality of electronic pickup elements during play.

It is still another object of this invention is to provide a plurality of interchangeable fret boards to create a plurality of different sounds.

It is a further object of this invention to provide a tremolo mechanism separably operable for each one of the strings of the stringed instrument.

Further objects and advantages of the invention will become apparent as the following description proceeds and the features of novelty which characterize the invention will be pointed out with particularity in the claims annexed to and forming part of the specification.

BRIEF DESCRIPTION OF THE DRAWINGS

The present invention may be readily described by reference to the accompanying drawings in which:

FIG. 3 is a side schematic view of a tremolo mechanism of the bass guitar of FIG. 1;

FIG. 4 is a side exploded view of the tremolo mechanism of FIG. 3;

FIG. 5 is a side exploded view of an interchangeable fret board with male and female locking member and top and bottom halves of guitar body with male and female locking clips of the present invention;

FIG. 6 is a side view of a snap used in the male and female locking clips of FIG. 5;

FIG. 7 is a side exploded view of the snap of FIG. 6;

FIG. 8 is a detail showing the attachment mechanism used to interchange the fret boards of FIG. 5;

FIG. 9 is a top view of a fret board;

FIG. 10 is a top view of a female locking member of FIG. 5;

FIG. 11 is a bottom view of a male locking member of FIG. 5;

FIG. 12 is a close up view of a fret board;

FIG. 13 is a close up perspective view of one of the female locking member elements;

FIG. 14 is a side view of a male and a female locking member engaged and disengaged;

FIG. 15 is a close up perspective view of one of the male locking member elements;

DESCRIPTION OF THE PREFERRED EMBODIMENT

Figure 1:
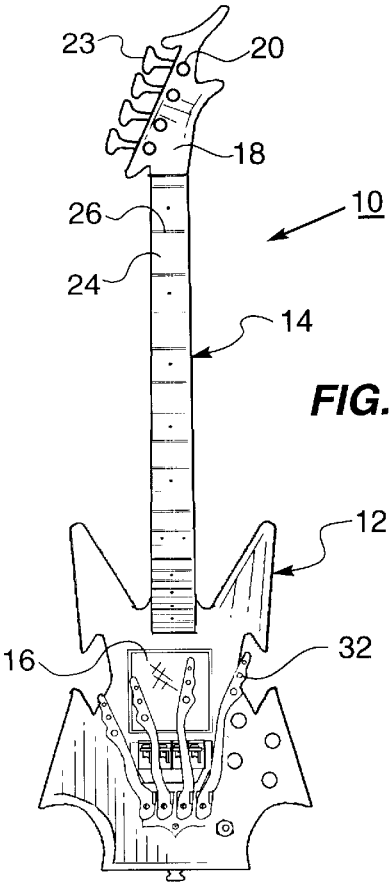
FIG. 1 is a front view of a bass guitar of the present invention.

Referring more particularly to the drawings by characters of reference, FIG. 1 shows a electric bass guitar 10 comprising a guitar body 12 with a guitar neck 14 extending forwardly therefrom. Guitar neck 14 includes a tuning portion 18 mounted opposite guitar body 12 having four posts 20 each of which are adapted to receive one end of a guitar string 22. Four corresponding tuning knobs 23 allow a user to rotate said corresponding posts 20 to increase and decrease the tension on guitar string 22 thereby allowing a user to tune said strings 22 as is well known in the art.

Extending the length of guitar neck 14 between tuning portion 18 and guitar body 12 is a fret board 24 having a plurality of frets 26 thereon. As is also well known in the art, a user is effectively shortens the length of guitar string 22 by use of finger pressure to bring said string into contact with a selected fret 26 thereby changing the note played when said string 22 is strummed by the user.

A pickup element area 16 is positioned on guitar body 12 in a line defined along fret board 24 underneath strings 22 and rearwardly the end of fret board 24. Area 16 includes electronic pickups 28, seen in FIG. 17, which are described in more detail below. Area 16 is generally located in the area a user strums guitar strings 22.

Figure 2:
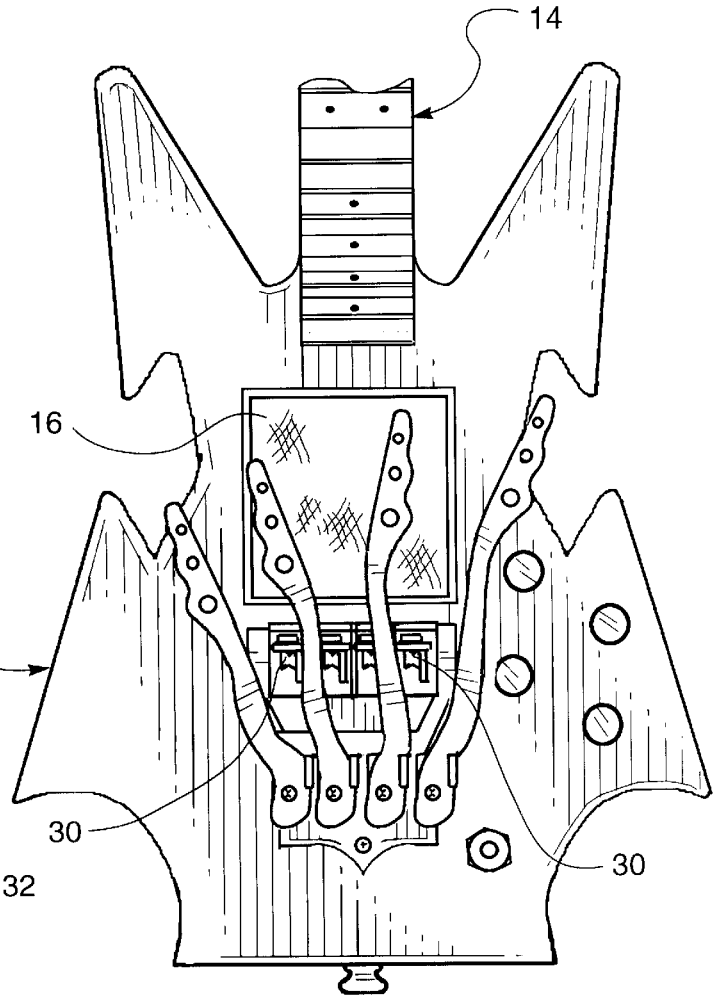
FIG. 2 is a front close up view of a body of the bass guitar of FIG. 1.

As best seen in FIGS. 2 and 3, each guitar string 22 passes over a corresponding guitar bridge 30 positioned proximate to area 16 and is rearwardly thereafter attached to an individual tremolo mechanism 32. One key to the invention is the provision of individual tremolo mechanisms 32 for each separate guitar string 22.

As best seen in FIG. 3, tremolo mechanism 32 includes a mount 34 which receives an end of guitar string 22, a pivot 36 mounted to guitar body 12, a short pivot arm 38 extending rearwardly opposite guitar string 22, a tremolo arm 40 which extends upwardly and then forwardly from short pivot arm 38 and a compression spring 42 which extends downwardly and forwardly from the distal end of short pivot arm 38 and resiliently biases pivot 36 in a clockwise direction as viewed from the perspective of FIG. 3. The end of compression spring 42 opposite arm 36 is mounted on the interior of body 12.

Turning now to FIGS. 3 and 4, one embodiment of tremolo mechanism 32 and guitar bridge 30 are provided. Those skilled in the art will recognize that the exact details of construction of these elements as provided herein are exemplary in nature and do not limit the invention to the particular details thereof.

Guitar bridge 30 comprises a rubber bridge controller 44 which is interposed between a single bridge rocker 46 and guitar body 12 to dampen harmonic interference between rocker 46 and body 12. Single bridge rocker 46 comprises a mounting arm 48 which includes a screw slot 50 adapted to receive a intonation screw 52 which extends through slot 50 and secures mounting arm 48 and controller 44 to body 12. A base 54 extends laterally from mounting arm 48 provides support for two pulley arms 56 which extend forwardly from base 54. A pulley 58 is rotatably mounted on an axle 60 which extends between pulley arms 56. A support bar 61 extends between pulley arms 56 opposite base 54 to provide further structural support for rocker 46.

Means for attaching a guitar string to tremolo mechanism 32 comprises short pivot arm 38 having a laterally extending hollow openended cylinder 62 at one end thereof. Captured within cylinder 62 is a laterally extending string holder 64 having a cavity 66 centered therein Cavity 66 is adapted to receive and retain a base 68 of a string sleeve 70 from which string 22 extends. String sleeve 70 extends forwardly through a hole 72 in cylinder 62. A pivot axle 74 extends through cylinder 62. A carbon plastic slide 76 covers the forward face of cylinder 62 and is in turn covered by a slide cup 78.

In the preferred embodiment, tremolo arm 40 comprises a tremolo arm guiding bar 80 which curves upwardly and forwardly from the rear of short pivot arm 38 where it is joined to a tremolo arm portion 82 being secured thereto by nut, bolt and washer combination 84.

Compression spring 42 is attached to short pivot arm 38 via a mounting bracket 86 which curved downwardly from arm 38. The opposite end of compression spring 42 is attached to the interior of guitar body 12 by an L-shaped bracket 88, one leg of bracket 88 being secured to body 12 by screw 90 and the opposite end of compression spring 42 being secured to the other leg of bracket 88.

The advantage of the present invention over the prior art is the ability of the user to utilize a tremolo effect for each individual string 22 as opposed to the prior art system whereby one tremolo bar is employed, that one tremolo bar actuating the tremolo effect for all strings at once. The ability to actuate each string individually provides far more control for the musician as to the sound produced by guitar 10.

Another feature of the present invention is the ability to interchange fret boards 24. This allows the user musician to employ differing fret boards 24 with, for example, different spacing between frets 26, or even fret boards 24 without frets 26 at all.

The interchangeable fret boards 24 of the present invention are illustrated in FIGS. 9 to 15. FIG. 9 shows the top of fret board 24 with frets 26 spaced thereon while FIG. 12 provides a close up view thereof. A lip 92 is positioned at the tuning portion end of fret board 24.

FIG. 10 shows the bottom of fret board 24 having a plurality of female receptacles 94 spaced therein. As best seen in FIGS. 13 and 14, female receptacles 94 have an open box shaped area 96 and a contiguous occluded area 98 which, in the presently preferred embodiment, shows the profile of a right triangle with the hypotenuse thereof extending upwardly and forwardly from one side of box shaped area 96. Female receptacles 94 receive corresponding male receptacles 100 mounted on guitar neck 14 which, as best seen in FIGS. 14 and 15, have a box 102 with a contiguous overhang area 104 having the same right triangle profile as that of occluded area 98.

To attach fret board 24 to neck 14, male receptacles 100 are slidably received within corresponding female receptacles 94 as best seen in FIGS. 5 and 14. To secure, a snap 106, best seen in FIGS. 5 and 8, is positioned on tuning portion 16 to engage a reverse prong 108 on fret board 24. Snap 106 in combination with prong 108 prevents movement of fret board 24 relative to neck 14. The triangle shapes of overhang area 104 and occluded area 98 firmly engaging hold fret board 24 in position with respect to neck 14. Yet, simply releasing snap 106 allows the user to disengage fret board 24 easily and quickly.

Figures 16, 17:
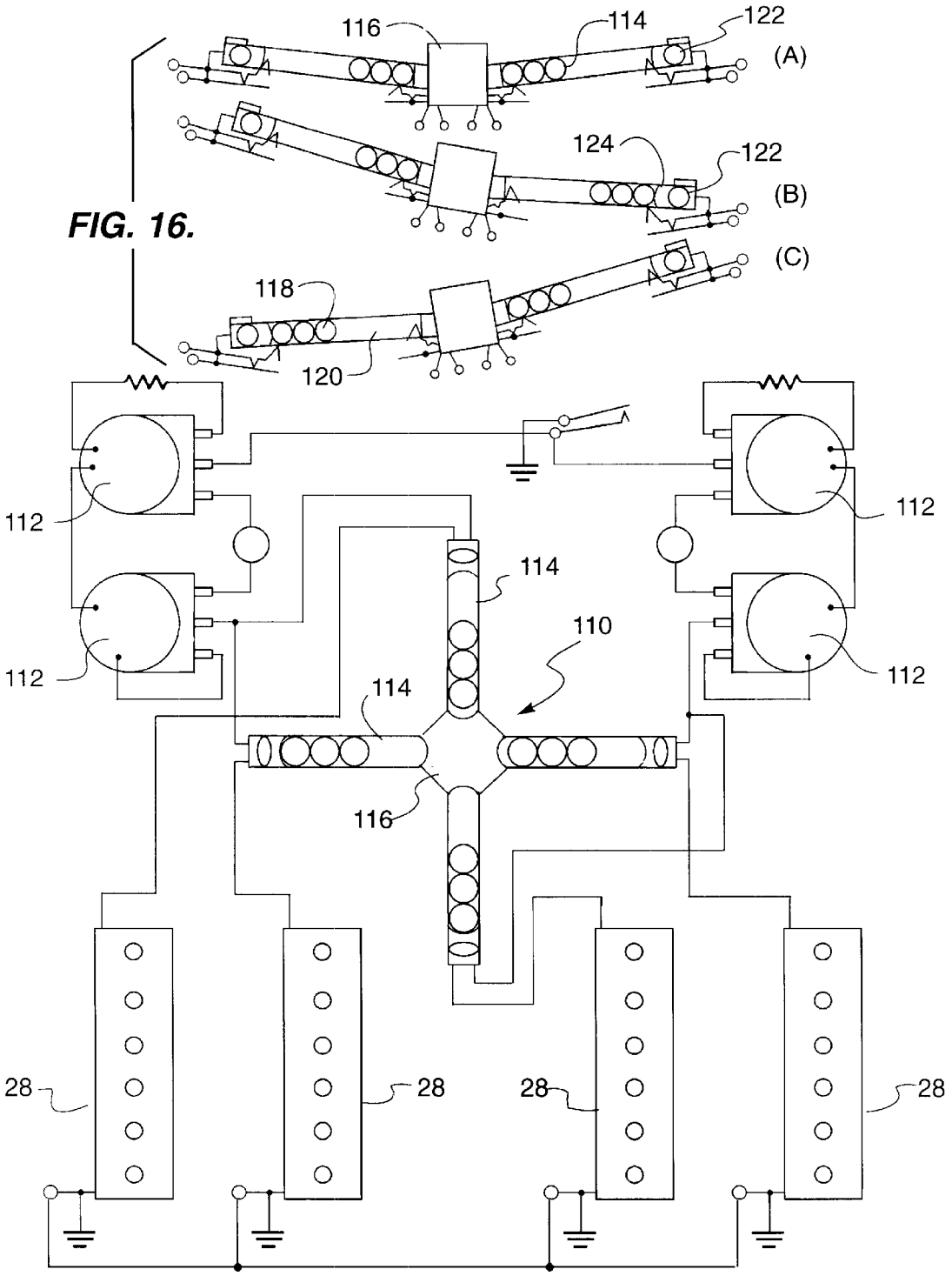
FIG. 16 is side view of a mercury switch used in the present invention in a three differing orientations.
FIG. 17 is a schematic view of the mercury switch of FIG. 16 electrically connected to a plurality of pickup elements.

Still another feature of the present invention is the use of a position sensitive switch 110 in conjunction with pickups 28 and resistors 112 to allow the user to control the sound of guitar 10 without ever needing to stop strumming. As shown in FIGS. 16 and 17, switch 110 is set up as a cross with four arms 114 extending at right angles to each other from a center point 116. In the preferred embodiment, two arms 114 extend rearwardly and forwardly while the other two arms extend upwardly and downwardly.

As is well known in the art, the position of pickups 28, the resistance with the circuit provided by resistors 112 and the type of pickups 28 all impact upon the sound quality ultimately produced.

As illustrated in FIG. 16, each such pair of arms 114 has three ball bearings 118 contained within a tube 120 but free to roll within tube 120. At the distal end of each tube 120 is a mercury switch 122 which is actuated when ball bearings press upon diaphragm 124 which covers one end of tube 120.

Each opposing pair of arms 114 has three possible positions. FIG. 16A illustrates a level position wherein neither mercury switch 122 is actuated. FIG. 16B corresponds to actuation of the right side mercury switch 122 when the entire switch 110 is tilted in that direction while FIG. 16C illustrates the actuation of left side mercury switch 122 when switch 110 is tilted in that direction.

As shown in FIG. 17, switch 110 and its mercury switch components 122 control which pickups are actuated by simply moving guitar 10. Thus, the guitarist controls the pickups used by either lifting or lowering neck 14 of guitar 10, or rotating body 12 of guitar 10 about an axis defined by neck 14. The present invention allows the guitarist to continue play without ever having to stop actually playing strings 22.

It will be apparent that a significantly improved guitar 10 is provided in accordance with the stated objects of the present invention, and while but a single embodiment of the invention has been illustrated and described, it will be apparent to those skilled in the art that various changes and modifications may be made therein without departing from the spirit of the invention or from the scope of the appended claims.

What is claimed is:

1. A bass guitar comprising, in combination, a body with a neck extending forwardly therefrom, the neck having a tuning portion mounted opposite the body adapted to receive one end of a plurality of strings, the tuning portion having means for adjusting the tension on each of the plurality of strings, the other end of the plurality of stings attached to the body, at least one pickup element is positioned on the body proximate to the neck, the plurality of stings extending over the at least one pickup element, and a plurality of tremolo mechanisms corresponding to the plurality of strings, each of the plurality of tremolo mechanisms being attached to the other end of the corresponding one of the plurality of strings attached to the body.

2. The bass guitar of claim 1 wherein the at least one pickup element comprises a plurality of pickup elements in electrical communication with a position sensitive switch which determines which of the plurality of pickup elements is actuated in response to movement of the body.

3. The bass guitar of claim 2 further comprising a plurality of resistors in electrical communication with the position sensitive switch and the plurality of pickup elements.

4. The bass guitar of claim 2 wherein the position sensitive switch is a cross shape having two pair of arms, each pair extending in opposing directions, the two pair of arms extending at right angles to each other from a center point, one pair of arms extending rearwardly and forwardly while the other two pair of arms extending upwardly and downwardly.

5. The bass guitar of claim 4 wherein each arm has three ball bearings contained within a tube and separated from a mercury switch by a diaphragm at the distal end thereof, the mercury switch being actuated when the ball bearings press upon the diaphragm.

6. The bass guitar of claim 5 wherein each pair of arms has three positions, a level position wherein neither mercury switch is actuated, a first actuation position wherein one mercury switch is actuated when the entire switch is tilted in one direction towards the one mercury switch and a second actuation position wherein the other mercury switch is actuated when the entire switch is tilted towards the other mercury switch.

7. The bass guitar of claim 1 further comprising a fret board mounted on the neck, the fret board having a plurality of frets thereon.

8. The bass guitar of claim 7 further comprising means for interchanging fret boards.

9. The bass guitar of claim 8 wherein the means for interchanging comprises a plurality of female receptacles positioned on one of the fret board and the neck mating with a corresponding number of male receptacles positioned on the other of the fret board and the neck, the means for interchanging further comprising a snap for retaining the fret board on the neck.

10. The bass guitar of claim 9 wherein the male and female receptacles are a combination of a box shape with a contiguous right triangle shape.

11. The bass guitar of claim 1 further comprising a bridge positioned between the at least one pickup element and the tremolo mechanisms.

12. The bass guitar of claim 1 wherein each of the plurality of tremolo mechanisms comprises a mount which receives an end of the corresponding one of the plurality of strings, a pivot mounted to the body, a short pivot arm extending rearwardly from the one of the plurality of strings, a tremolo arm which extends upwardly and then forwardly from the short pivot arm and means for resiliently biasing the pivot in a selected direction.

13. The stringed instrument bass guitar of claim 12 wherein means for resiliently biasing is a compression spring which extends downwardly and forwardly from the distal end of the short pivot arm and is mounted on the interior of the body.

14. A stringed instrument comprising, in combination, a body with a neck extending forwardly therefrom, the neck having a tuning portion mounted opposite the body adapted to receive one end of a plurality of strings, the tuning portion having means for adjusting the tension on each of the plurality of strings, the other end of the plurality of stings attached to the body, a plurality of pickup elements positioned on the body proximate to the neck, the plurality of stings extending over the plurality of pickup elements, the plurality of pickup elements being in electrical communication with a position sensitive switch which determines which of the plurality of pickup elements is actuated in response to movement of the body, the position sensitive switch having a cross shape with two pairs of arms, each pair extending in opposing directions, the two pair of arms extending at right angles to each other from a center point, one pair of arms extending rearwardly and forwardly while the other two pair of arms extending upwardly and downwardly, each arm having three ball bearings contained within a tube and separated from a mercury switch by a diaphragm at the distal end thereof, the mercury switch being actuated when the ball bearings press upon the diaphragm.

15. The stringed instrument of claim 14 further comprising a plurality of resistors in electrical communication with the position sensitive switch and the plurality of pickup elements.

16. The stringed instrument of claim 14 wherein each pair of arms has three positions, a level position wherein neither mercury switch is actuated, a first actuation position wherein one mercury switch is actuated when the entire switch is tilted in one direction towards the one mercury switch and a second actuation position wherein the other mercury switch is actuated when the entire switch is tilted towards the other mercury switch.

17. The stringed instrument of claim 14 further comprising a fret board mounted on the neck, the fret board having a plurality of frets thereon.

18. The stringed instrument of claim 17 further comprising means for interchanging fret boards.

19. The stringed instrument of claim 18 wherein the means for interchanging comprises a plurality of female receptacles positioned on one of the fret board and the neck mating with a corresponding number of male receptacles positioned on the other of the fret board and the neck, the means for interchanging further comprising a snap for retaining the fret board on the neck.

20. The stringed instrument of claim 19 wherein the male and female receptacles are a combination of a box shape with a contiguous right triangle shape.

21. A bass guitar comprising, in combination, a body with a neck extending forwardly therefrom, the neck having a tuning portion mounted opposite the body adapted to receive one end of a plurality of strings, the tuning portion having means for adjusting the tension on each of the plurality of strings, the other end of the plurality of stings attached to the body, a plurality of pickup elements positioned on the body proximate to the neck, the plurality of stings extending over the plurality of pickup elements, the plurality of pickup elements being in electrical communication with a position sensitive switch which determines which of the plurality of pickup elements is actuated in response to movement of the body, a plurality of tremolo mechanisms corresponding to the plurality of strings attached to the end of the plurality of strings attached to the body, a fret board mounted on the neck, the fret board having a plurality of frets thereon, and means for interchanging fret boards.

22. The bass guitar of claim 21 wherein the means for interchanging comprises a plurality of female receptacles positioned on one of the fret board and the neck mating with a corresponding number of male receptacles positioned on the other of the fret board and the neck, the means for interchanging further comprising a snap for retaining the fret board on the neck.

23. The bass guitar of claim 21 wherein the male and female receptacles are a combination of a box shape with a contiguous right triangle shape.

24. A bass guitar comprising, in combination, a body with a neck extending forwardly therefrom, the neck having a tuning portion mounted opposite the body adapted to receive one end of a plurality of strings, the tuning portion having means for adjusting the tension on each of the plurality of strings, the other end of the plurality of stings attached to the body, a plurality of pickup elements positioned on the body proximate to the neck, the plurality of stings extending over the plurality of pickup elements, the plurality of pickup elements being in electrical communication with a position sensitive switch which determines which of the plurality of pickup elements is actuated in response to movement of the body, a plurality of resistors in electrical communication with the position sensitive switch and the plurality of pickup elements, the position sensitive switch being a cross shape having two pair of arms, each pair extending in opposing directions, the two pair of arms extending at right angles to each other from a center point, one pair of arms extending rearwardly and forwardly while the other two pair of arms extending upwardly and downwardly, each arm having three ball bearings contained within a tube and separated from a mercury switch by a diaphragm at the distal end thereof, the mercury switch being actuated when the ball bearings press upon the diaphragm, each pair of arms having three positions, a level position wherein neither mercury switch is actuated, a first actuation position wherein one mercury switch is actuated when the entire switch is tilted in one direction towards the one mercury switch and a second actuation position wherein the other mercury switch is actuated when the entire switch is tilted towards the other mercury switch, a plurality of tremolo mechanisms corresponding to the plurality of strings attached to the end of the plurality of strings attached to the body, the plurality of tremolo mechanisms each comprising a mount which receives an end of one of the plurality of strings, a pivot mounted to the body, a short pivot arm extending rearwardly the one of the plurality of strings, a tremolo arm which extends upwardly and then forwardly from the short pivot arm and a compression spring which extends downwardly and forwardly from the distal end of the short pivot arm and is mounted on the interior of the body for resiliently biasing the tremolo mechanism to a selected position, a fret board mounted on the neck, the fret board having a plurality of frets thereon, and a plurality of female receptacles positioned on one of the fret board and the neck mating with a corresponding number of male receptacles positioned on the other of the fret board and the neck, the male and female receptacles are a combination of a box shape with a contiguous right triangle shape, and a snap for retaining the fret board on the neck.

* * * * *